United States Patent [19]

Wakasa

[11] Patent Number: 4,530,323

[45] Date of Patent: Jul. 23, 1985

[54] CYLINDER HEAD STRUCTURE OF ENGINE

[75] Inventor: Akinori Wakasa, Hiroshima, Japan

[73] Assignee: Mazda Motor Corporation, Japan

[21] Appl. No.: 563,564

[22] Filed: Dec. 20, 1983

[30] Foreign Application Priority Data

Dec. 20, 1982 [JP] Japan ..... 57-192588[U]

[51] Int. Cl.[3] ..... F01P 3/14

[52] U.S. Cl. ..... 123/41.77; 123/41.82 R; 123/193 H

[58] Field of Search ..... 123/41.82 R, 41.72, 123/41.74, 41.76, 41.77, 193 H, 41.82 A, 193 R

[56] References Cited

U.S. PATENT DOCUMENTS

| | | | |
|---|---|---|---|
| 1,665,396 | 4/1928 | Woolson | 123/41.74 |
| 1,792,867 | 2/1931 | Radford | 123/41.76 |
| 2,753,853 | 7/1956 | Hands | 123/41.77 |
| 2,788,776 | 4/1957 | Holt | 123/41.82 R |

FOREIGN PATENT DOCUMENTS

| | | | |
|---|---|---|---|
| 491360 | 1/1919 | France | 123/41.74 |
| 47-24165 | 8/1972 | Japan . | |
| 53-123307 | 9/1978 | Japan . | |
| 54-15092 | 6/1979 | Japan . | |

*Primary Examiner*—Craig R. Feinberg
*Assistant Examiner*—David A. Okonsky
*Attorney, Agent, or Firm*—Murray, Whisenhunt and Ferguson

[57] ABSTRACT

A cylinder head to be mounted on a cylinder block for a multiple-cylinder in-line engine has an intake port and an exhaust port for each cylinder bore of the cylinder block, water jackets surrounding the intake ports and the exhaust ports, and a plurality of bolt holes for receiving head bolts for fixing the cylinder head to the cylinder block. The bolt holes are in the form of through-holes formed through boss portions which are disposed in the four corners and on a pair of opposed side portions of the cylinder head. The boss portions on the side portions are in positions corresponding to the "interbore" portions between adjacent cylinder bores of the cylinder block. The upper portions of each pair of boss portions laterally opposed to each other along the corresponding interbore portion are connected by a top deck extending above the interbore portion. The central portion of each top deck is connected with wall portions defining the intake port and the exhaust port on opposite sides of the top deck by way of a pair of reinforcing ribs.

7 Claims, 5 Drawing Figures

CYLINDER HEAD STRUCTURE OF ENGINE

BACKGROUND OF THE INVENTION

1. Field of the Invention

This invention relates to a structure of a cylinder head of an engine, and more particularly to a structure of a cylinder head of a multiple-cylinder, in-line engine.

2. Description of the Prior Art

Generally, the cylinder head of a multiple-cylinder, in-line engine is fixed to the cylinder block by head bolts inserted into bolt holes which are formed in the cylinder head at its four corners and at its side walls at positions opposed to portions of the cylinder block between adjacent bores. The clamping force of the head bolts, combustion pressure acting on the cylinder head and thermal strain due to combustion head are apt to cause problems. For example, in the arrangement shown in FIG. 1 where the cylinder head B is fixed to the upper surface of the cylinder block A with a gasket E sandwiched therebetween by head bolts D inserted into bolt holes C formed in the side walls of the cylinder head B at positions opposed to the portions of the cylinder block A between adjacent bores, the part of the lower deck F of the cylinder head B between the bolt holes C tends to be bowed upwardly as shown by the chained line in FIG. 1, whereby the contact pressure between the lower deck F and the upper surface of the cylinder block A is lowered at the center of the lower deck F. This tendency is especially significant when the cylinder head B is made of an aluminum alloy. Such upward bowing degrades the seal between adjacent cylinders. When the space between adjacent bores is reduced in order to miniaturize the engine, the seal between adjacent cylinders is further deteriorated to cause so-called gas-escape between the adjacent cylinders. Further, in a so-called same-flow type engine where the intake ports and the exhaust ports open on the same side of the cylinder head, rigidity on the opposite side of the cylinder head is lowered, and accordingly the problem of seal deterioration due to the deformation of the cylinder head is more significant.

In Japanese Unexamined Utility Model Publication No. 53(1978)-123307 is disclosed a structure of a cylinder head in which, as shown in FIG. 2, the cylinder head 1 is made of an aluminum alloy and a thermal insulating member 5 having a thermal conductivity lower than that of the aluminum alloy is embedded in a partition wall 3 between adjacent combustion chambers 2 along the surface of a gasket 4. The thermal insulating member 5 can act also as a reinforcement which increases the rigidity of the partition wall 3, whereby the problem described above can be avoided. However, this approach is disadvantageous in that the step of embedding the thermal insulating member 5 into the partition wall 3 during casting of the cylinder head is very troublesome and adds to the manufacturing cost.

SUMMARY OF THE INVENTION

In view of the foregoing observations and description, the primary object of the present invention is to provide an improved structure of the cylinder head which can improve the seal between adjacent bores to prevent gas-escape therebetween without significantly adding to the manufacturing cost of the cylinder head.

In accordance with the present invention, there is provided an improved structure of a cylinder head to be mounted on a cylinder block for a multiple-cylinder in-line engine. The cylinder head has an intake port and an exhaust port for each cylinder bore of the cylinder block, water jackets surrounding the intake ports and the exhaust ports, and a plurality of bolt holes for receiving head bolts for fixing the cylinder head to the cylinder block. The bolt holes are in the form of through-holes formed through boss portions which are disposed in the four corners and on a pair of opposed side portions of the cylinder head. The boss portions on the side portions are in positions corresponding to the portions between adjacent cylinder bores of the cylinder block. (The portions between adjacent cylinder bores of the cylinder block will be referred to as "interbore portions", hereinbelow.) The upper portions of each pair of boss portions laterally opposed to each other along the corresponding interbore portion are connected by a top deck extending above the interbore portion. The central portion of each top deck is connected with at least one of the wall portions defining the intake port and the exhaust port on opposite sides of the top deck by way of a reinforcing rib.

In the structure of the cylinder head in accordance with the present invention, the clamping force of the head bolts is transmitted to the central portion of the lower deck from both side portions of the cylinder head by way of the top decks, the reinforcing ribs, and the wall portions defining the intake port or the exhaust port, whereby the contact pressure between the lower surface of the lower deck and the upper surface of the cylinder deck at the center of the lower deck is increased and the seal between adjacent cylinder bores is improved.

DESCRIPTION OF THE PREFERRED EMBODIMENT

Figure 1:
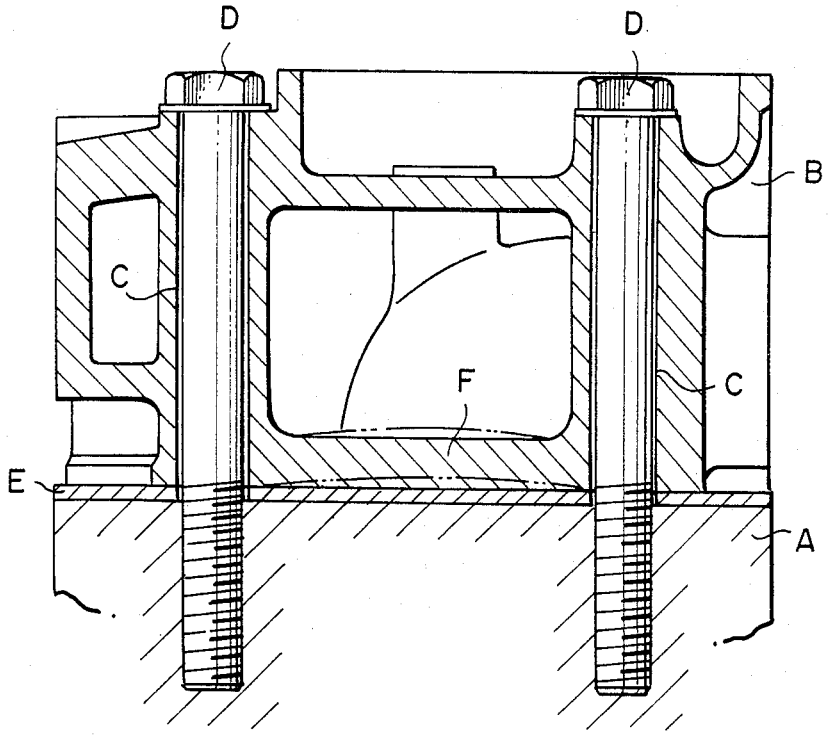
FIG. 1 PRIOR ART
FIG. 1 is a fragmentary cross-sectional view illustrating the problems in the conventional structure of the cylinder head.
Figure 2:
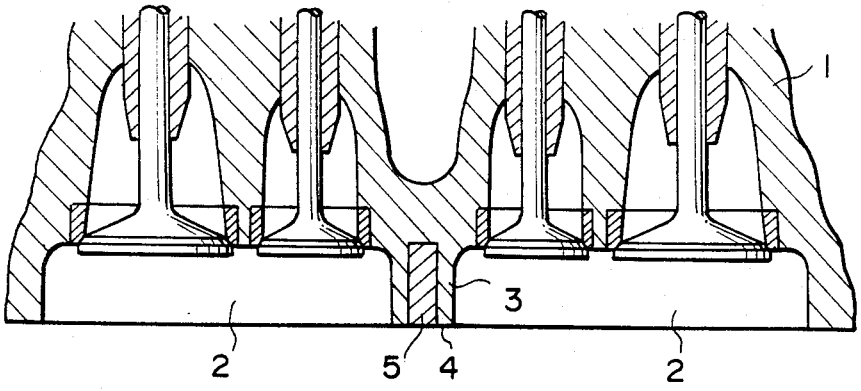
FIG. 2 PRIOR ART
FIG. 2 is a fragmentary cross-sectional view illustrating the structure of the cylinder head disclosed in Japanese Unexamined Utility Model Publication No. 53(1978)-123307.
Figure 3:
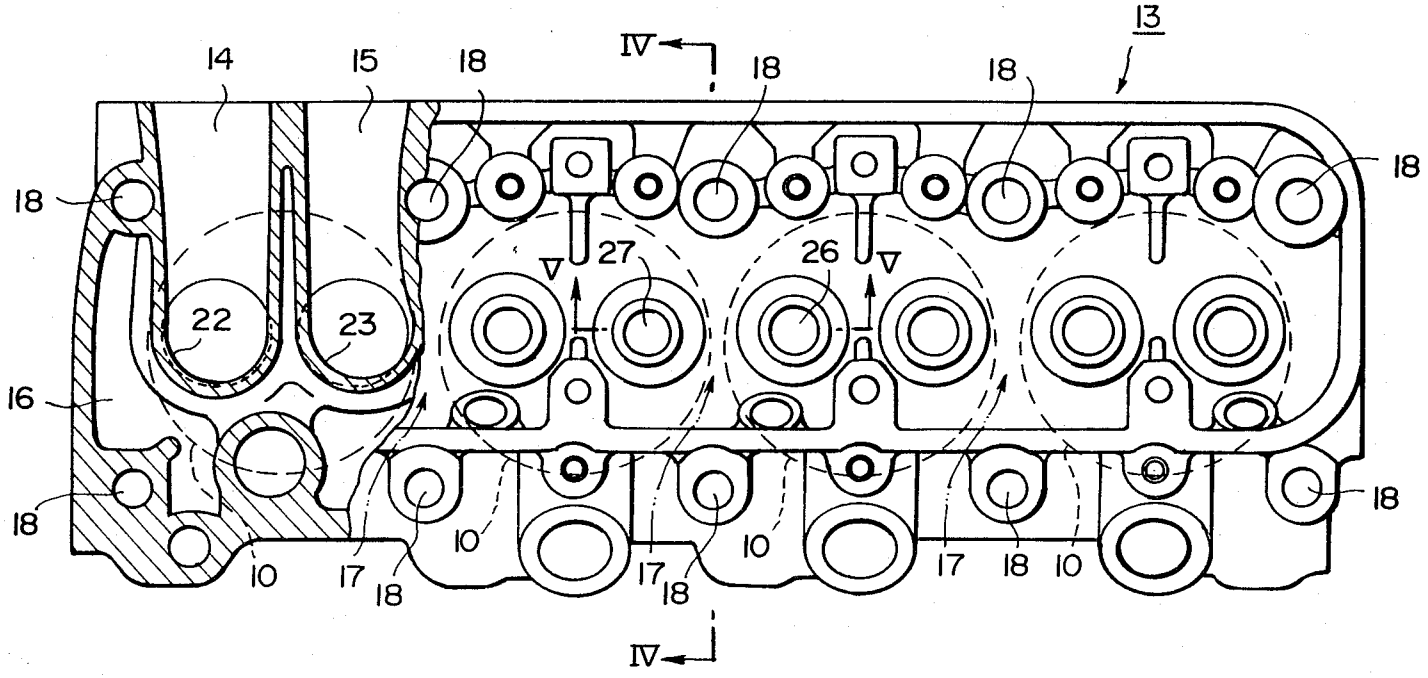
FIG. 3 is a plan view, partly in cross-section, of a cylinder head in accordance with an embodiment of the present invention.
Figure 4:
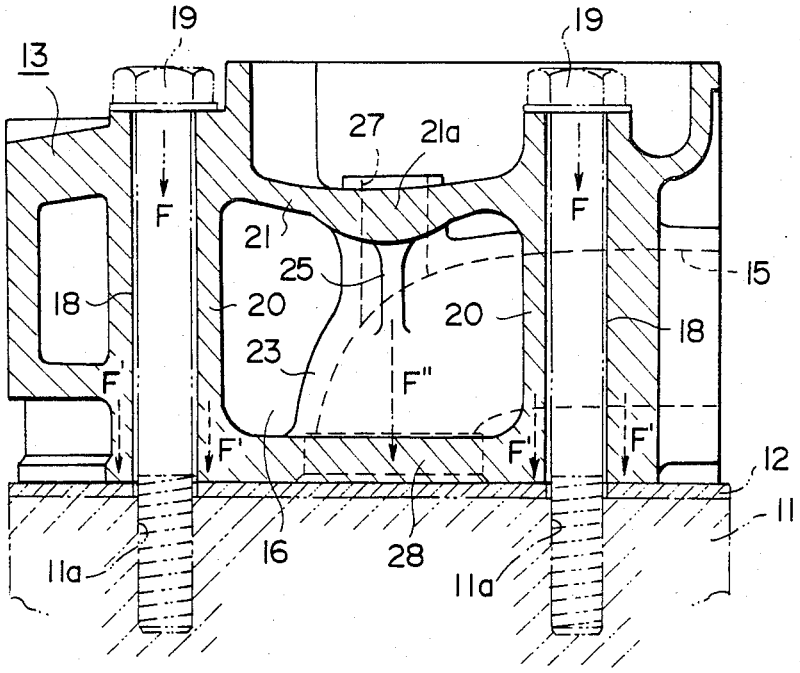
FIG. 4 is an enlarged cross-sectional view taken along line IV—IV in FIG. 3.
Figure 5:
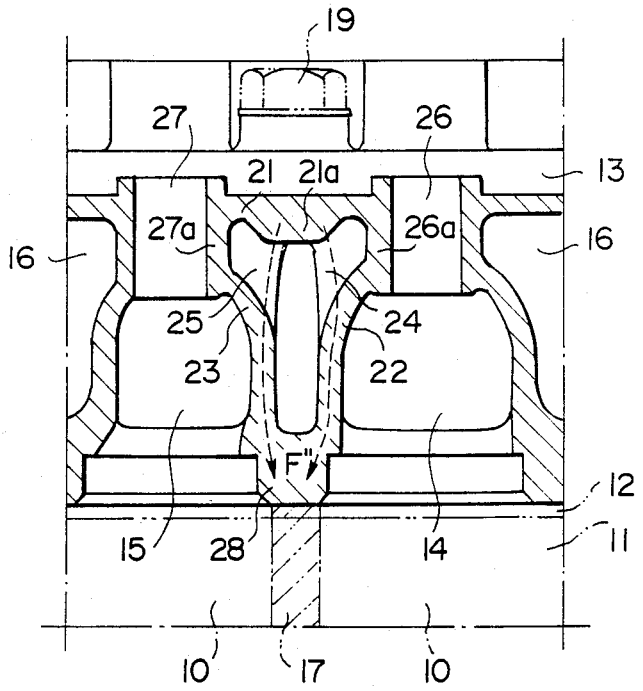
FIG. 5 is an enlarged cross-sectional view taken along line V—V in FIG. 3.

In FIGS. 3 to 5, a cylinder head 13 is mounted on a cylinder block 11 having a plurality of cylinders 10 arranged in line to close the top of the cylinders 10 with a gasket 12 sandwiched therebetween. The cylinder head 13 is made by, for instance, casting an aluminum alloy and is provided with an intake port 14 and an exhaust port 15 for each cylinder 10. Water jackets 16 are formed to surround the intake port 14 and the exhaust port 15 for each cylinder 10. The cylinder head 13 is provided with bolt holes 18 in the form of vertical through-holes formed through bosses 20 disposed in the four corners and on side portions thereof. The bosses 20 on the side portions are in positions corresponding to interbore portions 17 of the cylinder block 11 between adjacent cylinders 10. The cylinder head 13 is secured to the upper surface of the cylinder block 11 by a plurality of head bolts 19 which are respectively passed through the bolt holes 18 and screwed into threaded holes 11*a* in the cylinder block 11 as shown by chained lines in FIG. 4. Each top deck 21 connecting the top portions of the bosses 20 for the bolt holes 18 laterally opposed to each other is bowed downwardly and the wall thickness of the top deck 21 is enlarged at the central portion 21*a* as clearly shown in FIG. 4. As shown in FIG. 5, a reinforcing rib 24 connects the central portion 21*a* of the top deck 21 with the wall portion 22 defining the intake port 14 on one side of the top deck 21 and, as shown in FIG. 4, a similar reinforcing rib 25 connects the central portion 21*a* of the top deck 21 with the wall portion 23 defining the exhaust port 15 on the other side of the top deck 21. Valve stem guide holes 26 and 27 respectively communicating with the intake port 14 and the exhaust port 15 for each cylinder 10 are formed in the cylinder head 13. The reinforcing ribs 24 and 25 are integrally formed with the wall portions 26*a* and 27*a* respectively defining the valve stem guide holes 26 and 27. As can be seen from FIG. 3, the intake port 14 and the exhaust port 15 for each cylinder 10 open on the same side of the cylinder head 13 in this embodiment. That is, the cylinder head 13 of this embodiment is of so-called same-flow type.

The clamping force F of each head bolt 19 screwed into the threaded hole 11*a* formed in the interbore portion 17 of the cylinder block 11 is directly transmitted to the side portion of the corresponding lower deck 28 by way of the boss 20 for the bolt hole 18 as shown by the arrows F′ in FIG. 4, and at the same time to the central portion of the lower deck 28 by way of the top deck 21, the reinforcing rib 24 and the wall portion 22 or the top deck 21, the reinforcing rib 25 and the wall portion 23 as shown by the arrows F″ in FIGS. 4 and 5. Accordingly the cylinder head 13 and the cylinder block 11 are pressed against each other with a large contact pressure also at the central portion of the lower deck 28. That is, the cylinder head 13 is pressed against the upper surface of the cylinder block 11 with a substantially uniform contact pressure over the entire length of each interbore portion 17, whereby the seal between the cylinders on opposite sides of the interbore portion 17 is improved. Especially in the illustrated embodiment where the top deck 21 is bowed downwardly and the wall thickness of the central portion 21*a* of the top deck 21 is enlarged, the clamping force of the head bolt 19 is effectively transmitted to the reinforcing ribs 24 and 25 by way of the top deck 21 from the upper portion of the boss 20, whereby the contact pressure at the central portion of the lower deck 28 is further increased.

Though in the illustrated embodiment, the present invention is applied to a same-flow type cylinder head, the present invention can be applied also to a cross-flow type cylinder head where the intake port and the exhaust port open on opposite sides of the cylinder head. Further, though in the illustrated embodiment, each top deck 21 is provided with a pair of reinforcing ribs 24 and 25 which respectively extend from the top deck 21 to the wall portions 22 and 23 on opposite sides of the top deck 21, each top deck 21 may be provided with only a single reinforcing rib which extends from the top deck 21 to one of the wall portions on opposite sides of the top deck 21.

I claim:

1. A structure of a cylinder head, having four corners, which is adapted to be mounted on a cylinder block for a multiple-cylinder in-line engine having a plurality of cylinder bores arranged in line and spaced from each other by interbore portions extending between a pair of opposed side portions of the cylinder block, said cylinder head having respective wall portions defining an intake port and an exhaust port for each cylinder bore of the cylinder block, said intake ports and said exhaust ports arranged in line parallel to said cylinder bores arranged in line, water jackets surrounding the intake ports and the exhaust ports, a cooling water passage provided between the water jackets surrounding the ports which are opposed to each other and spaced apart by said interbore portion, and a plurality of bolt holes for receiving head bolts for fixing the cylinder head to the cylinder block, the bolt holes being in the form of through-holes formed through boss portions disposed in said four corners and on said pair of opposed side portions of the cylinder head, the boss portions on the side portions corresponding to the interbore portions of the cylinder block, the upper portions of each pair of boss portions laterally opposed to each other along the corresponding interbore portion of the cylinder block being connected by a top deck having a central portion extending above the interbore portion of the cylinder block, the head bolts respectively passable through the cylinder head from above the top deck to secure the cylinder head to the cylinder block, wherein the improvement comprises that the central portion of each top deck is connected with at least one of the wall portions defining said intake port and the exhaust port on opposite sides of the top deck by way of a reinforcing rib, said at least one of the wall portions facing the interbore portion.

2. A structure of a cylinder head as defined in claim 1 in which said central portion of each top deck is connected with bore the wall portions defining the intake port and the exhaust port on opposite sides of the top deck by a pair of reinforcing ribs, and said water jackets are formed between the reinforcing ribs.

3. A structure of a cylinder head as defined in claim 1 in which said reinforcing rib is integrally formed with the wall portion defining said intake port.

4. A structure of a cylinder head as defined in claim 1 in which said intake port and the exhaust port open on the same side of the cylinder head.

5. A structure of a cylinder head as defined in claim 1 in which said reinforcing rib is integrally formed with the wall portion defining said exhaust port.

6. A structure of a cylinder head as defined in claim 1 in which each of said top decks is bowed downward and said central portion thereof forms the lowermost portion.

7. A structure of a cylinder head as defined in claim 6 in which the wall thickness of the central portion of each top deck is enlarged.

* * * * *